United States Patent [19]

Hofius

[11] 3,951,715

[45] Apr. 20, 1976

[54] SLIDE FASTENERS AND METHOD OF MAKING THE SAME

[75] Inventor: David V. Hofius, Meadville, Pa.

[73] Assignee: Textron, Inc., Providence, R.I.

[22] Filed: Feb. 24, 1975

[21] Appl. No.: 552,458

Related U.S. Application Data

[62] Division of Ser. No. 293,183, Sept. 28, 1972, Pat. No. 3,872,552.

[52] U.S. Cl. ..... 156/66; 24/205.11 F; 29/207.5 ST; 156/73.1

[51] Int. Cl.[2] ..... B32B 31/20

[58] Field of Search..... 24/205.11 R, 205.11 F, 24/205 R; 29/207.5 ST; 156/66, 73.1

[56] References Cited

UNITED STATES PATENTS

| | | | |
|---|---|---|---|
| 3,001,904 | 9/1961 | Porepp | 24/205.11 F |
| 3,748,709 | 7/1973 | Potin | 156/66 |

*Primary Examiner*—Edward G. Whitby

[57] ABSTRACT

A slide fastener including fastener elements formed from continuous filaments of plastic material and carried by cords along inner edges of a pair of tapes, a slider having channels extending therethrough with diverging throats adjacent a diamond post in the slider, and a pair of stop members secured to the pair of tapes at the inner edges, each of the stop members engaging end abutments of the slider to limit movement of the slider and having legs extending obliquely to the inner edges of the tapes such that the legs are received in the throats of the slider when the slider is moved to close the slide fastener to prevent splay of the tapes. The cords have portions of reduced cross section between the stop members and terminal elements of the fastener elements and the slider can be assembled to receive the fastener elements after forming of the stop members by disposing the slider to receive the cord portions of reduced cross section and moving the slider along the cords away from the stop members.

13 Claims, 9 Drawing Figures

SLIDE FASTENERS AND METHOD OF MAKING THE SAME

CROSS REFERENCE TO RELATED APPLICATION

This is a divisional application of pending application Ser. No. 293,183 filed Sept. 28, 1972, now U.S. Pat. No. 3,872,552.

BACKGROUND OF THE INVENTION

1. Field of the Invention:

The present invention pertains to slide fasteners and methods of assembly thereof, and, more particularly, to slide fasteners configured to prevent splaying of the tapes of the slide fasteners when closed and methods of assembling the sliders on such slide fasteners after top stops are formed on the tapes.

2. Description of the Prior Art:

Slide fasteners conventionally include end stops to limit movement of a slider therefor, the end stops normally including a bottom stop for limiting opening movement of the slider and a top stop for limiting closing movement of the slider. The bottom stop, for many applications, is not externally visible after installation in a garment and is normally installed in a grament where the material is joined such that the bottom stop can have a variety of configurations without irritating the wearer of the garment, without adversely affecting its functional requirements and without hampering installation in a garment. Top stops, however, are normally relatively prominent and visible after installation in garments and are required to be precisely positioned with respect to the fastener elements of the slide fastener to permit separation thereof.

In the past, along with the aesthetic and positioning problems associated with top stops as mentioned above, a particular problem has been encountered at the top portion of the tapes adjacent the top stop in that when the slider is positioned to engage the top stop the diamond post of the slider is disposed between terminal fastener elements such that the upper ends of the slide fastener tapes extending above the top stop are splayed. Splay is further caused by the separation of the top stop members by the diamond post, and this splay is highly undesirable from an aesthetic standpoint as well as causing difficulties in installation of the slide fastener in a garment. These difficulties are accentuated as progress is made in the development of new techniques for quickly and automatically securing slide fasteners to materials, such as electrostatic methods now being incorporated in mass production lines. The problem of splay caused by the diamond post of a slider spacing the terminal fastener elements has been solved by reducing the size of the terminal fastener elements as described in U.S. Pat. No. 3,672,008; however, the problem of splay caused by spacing of the top stop members between the diamond post has not been satisfactorily solved.

Top stops for slide fasteners are conventionally made of bands of metal or other material folded upon themselves and around cords at the inner edges of the slide fastener tapes to which the fastener elements are attached. Such top stops have the disadvantages of being relatively difficult and expensive to apply to the slide fasteners and, additionally, are unattractive as viewed from the exterior side of the slide fastener and are irritating to the wearer of the garment on the interior side of the slide fastener.

With the advent of slide fasteners utilizing fastener elements formed of continuous filaments of deformable plastic material, attempts have been made to provide top stops of similar plastic material to reduce assembly and material costs as well as to permit dyeing of the top stops for aesthetic purposes. Such prior art attempts, however, have not solved the problems involved in the production of top stops for a slide fastener due to the flash and jagged edges resulting from the cutting of single bars of material fused to both tapes simultaneously and the problem of splay caused by spacing of the top stop members. The problem of providing a top stop of plastic material is further made difficult in that the portions of the tapes above the top stops are required to be flexible to permit folding of the tapes during installation in a garment thereby rendering it desirable to have the upper edge of the top stop well defined.

The development of techniques for forming top stops of plastic material on slide fastener tapes has increased the speed of production of slide fasteners; however, speed of production is still relatively slow due to the necessity of forming top and bottom stops during separate operations. The reason for the separate operations is that the bottom stop is desirably secured to the tapes prior to assembly of the slider and the top stop is secured to the tapes after assembly of the slider since the stop members of the top stop are purposely designed so as not to pass through the channels in the slider.

Some of the disadvantages of requiring the slider to be assembled after application of the bottom stop but prior to application of the top stop are that additional equipment and manual handling operations are required, production speed is decreased, slide fasteners cannot feasibly be shipped from the manufacturer until the entire slide fastener is assembled, and broken sliders cannot be replaced without removing the top stop, installing a new slider and applying a new top stop.

SUMMARY OF THE INVENTION

Accordingly, it is a primary object of the present invention to overcome the above mentioned problems and disadvantages in slide fasteners and methods of assembly thereof.

A further object of the present invention is to permit installation of a slider on a slide fastener after a top stop is formed on the slide fastener.

The present invention has another object in a method of manufacturing slide fasteners including reducing the cross section of portions of the cords along the inner edges of slide fastener tapes and installing a slider after stop members are formed on the tapes at the reduced cross section cord portions by introducing the slider at the reduced cross section cord portions.

Yet a further object of the present invention is to simultaneously form top and bottom stops on a slide fastener.

Another object of the present invention is to construct a slide fastener having top stop members made of a plastic material and configured to prevent splay of the slide fastener tapes.

An additional object of the present invention is to position top stop members in spaced relation to the terminal fastener elements of a slide fastener such that a slider can be installed on the slide fastener in the area between the terminal fastener elements and the top stop members when the tapes of the slide fastener are slightly splayed.

A further object of the present invention is to construct shoulders of reduced thickness on top stop members such that the shoulders permit installation of a slider thereover but serve to guide the slider to the bodies of the top stop members to limit opening movement of the slider.

The present invention has an additional object in that top and bottom stops for a slide fastener are formed of a fusible plastic material and simultaneously secured to slide fastener tapes on a side opposite the side from which a pull on the slider extends.

Yet another object of the present invention is to configure top stop members for a slide fastener to be received in diverging throats in a slider to close the extensions of the slide fastener tapes above the top stop members in parallel alignment without splay.

Some of the advantages of the slide fastener of the present invention over the prior art are that the top and bottom stops may be simultaneously applied to the slide fastener tapes, the top stops prevent splay of the slide fastener tape extensions, the slider can be installed after forming of the top stop members, sliders can be replaced on the slide fasteners without removing and replacing top stops and the top stops permit installation of a slider thereover while still functioning to limit closing movement of the slider.

The present invention is generally characterized in a slide fastener including a pair of tapes, fastener elements carried by cords along the inner edges of the pair of tapes, a slider for controlling interengagement of the fastener elements and including a pair of channels therethrough with diverging throats, and a pair of stop members secured to the pair of tapes at the inner edges to engage the slider and limit movement thereof, each of the stop members having legs extending obliquely to the inner edges of the tape to be received in the throats of the slider when the slider engages top stop members and shoulders of reduced thickness extending from the legs to facilitate installation of the slider and guide the slider to the stop members when the slider is moved to close the slide fastener.

The present invention is further generally characterized in methods of assembly and manufacture of slide fasteners with the slider installed after forming of the top stop, the methods including introducing the slider for installation at gapped areas of reduced cross section portions of the cords between the stop members and the terminal fastener elements, introducing the slider for installation at reduced cross section portions of the cords, or introducing the slider for installation at gapped areas between the stop members and the terminal fastener elements.

Other objects and advantages of the present invention will become apparent from the following description of the preferred embodiments taken in conjunction with the accompanying drawings.

DESCRIPTION OF THE PREFERRED EMBODIMENTS

Figure 1:
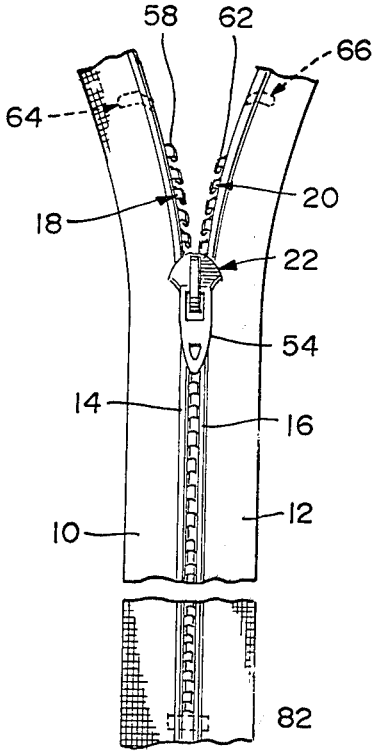
FIG. 1 is a broken front elevation of a slide fastener having a top stop according to the present invention.
Figure 2:
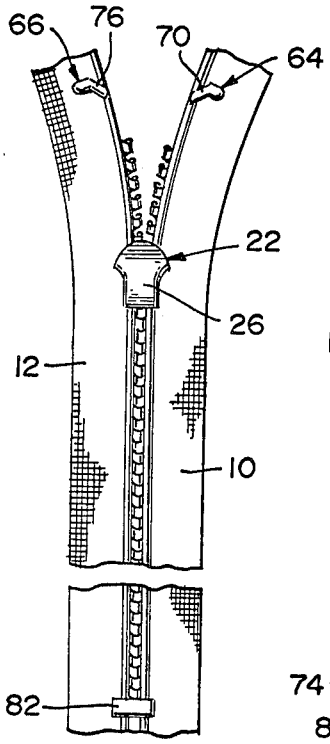
FIG. 2 is a broken rear elevation of the slide fastener of FIG. 1 in a partially open state.

A slide fastener constructed in accordance with the present invention is illustrated in FIGS. 1 and 2 and includes a pair of woven tapes 10 and 12 having thickened cords 14 and 16, respectively, running longitudinally along the inner edges thereof. A plurality of fastener elements 18 and a plurality of fastener elements 20 are carried along the inner edges of tapes 10 and 12 by cords 14 and 16, respectively, and each plurality of fastener elements are made of a continuous filament of deformable plastic material, such as nylon. The fastener elements illustrated have a coiled configuration with the edges of the coils facing each other and adapted to be interengaged by movement of a slider 22. While a coiled configuration of fastener elements has been illustrated, the present invention is not limited thereto but rather can utilize fastener elements individually or continuously formed and of various configurations, such as a ladder-like configuration or other configurations suitable for interengagement.

Figure 2A:
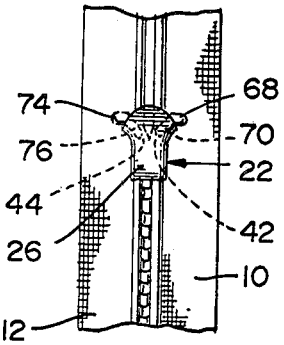
FIG. 2A is a partial rear elevation of the slide fastener of FIG. 1 in a closed state.
Figure 3:
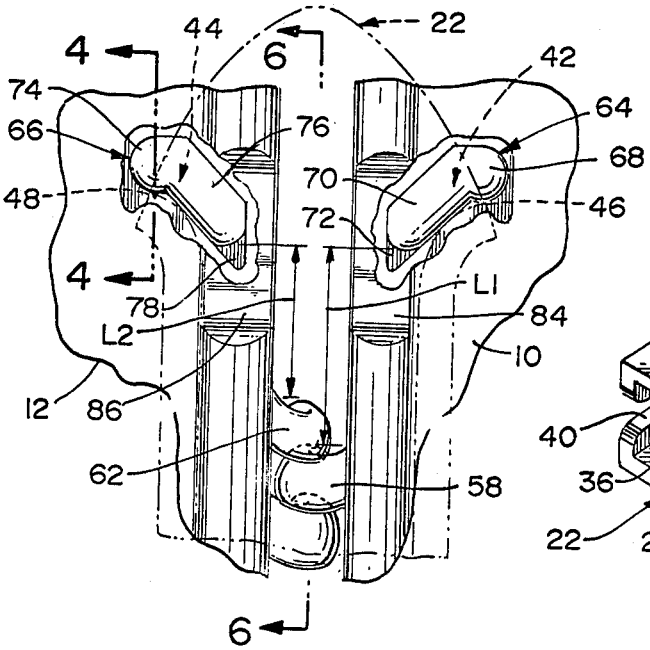
FIG. 3 is an enlarged broken rear elevation of the slide fastener of FIG. 1 in the closed state and with the slider illustrated by dotted lines.
Figure 5:
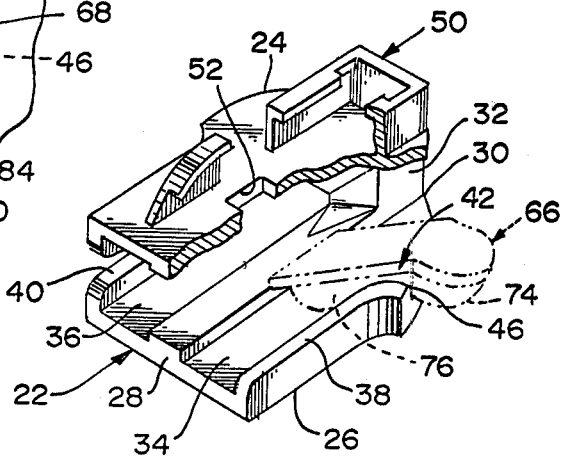
FIG. 5 is a broken perspective illustrating the cooperation between a slider and a top stop member according to the present invention.
Figure 6:
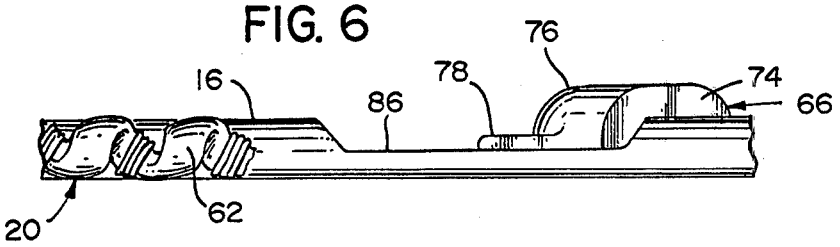
FIG. 6 is a section taken along line 6—6 of Fig. 3.

The slider 22, as best illustrated in FIG. 5, has superposed upper and lower wings 24 and 26 extending between a tail 28 and a nose 30 of the slider. A diamond post 32 is disposed adjacent the end of slider 22 between upper and lower wings 24 and 26, and the upper and lower wings extend laterally on opposite sides of the post 32 to define a pair of longitudinal channels 34 and 36 through the slider for receiving cords 16 and 14 and fastener elements 20 and 18, respectively, Lower wing 26 has marginal flanges 38 and 40 extending transversely therefrom, and upper wing 24 similarly has marginal flanges extending transversely therefrom to cooperate with marginal flanges 38 and 40 to define the longitudinal channels 34 and 36, respectively. The channels 34 and 36 extend along opposite sides of the post 32 such that the channels converge at the end 28 of the slider and form diverging throats 42 and 44 at the end 30 of the slider, as shown in FIGS. 2A and 3. The marginal flanges 38 and 40 of the lower wing 26 terminate at end abutments 46 and 48, respectively. Upper wing 24 carries housing structure generally indicated at 50 associated with an aperture 52 in the upper wing 24 to support a spring element for providing a locking function controlled by a pull 54 as described in application Ser. No. 857,998 filed Sept. 15, 1969 and assigned to the assignee of the present invention.

In accordance with the present invention, a top stop for the slide fastener includes a pair of stop members 64 and 66 secured to tapes 10 and 12, respectively, spaced from terminal elements 58 and 62 of fastener elements 18 and 20, respectively, such that spaces or gaps L1 and L2 exist therebetween. Accordingly, the slider 22 moves along cords 14 and 16 between the terminal fastener elements and the stop members 64 and 66.

Stop member 64 has a body including a lug portion 68 extending substantially transverse to the inner edge of tape 10 and a leg 70 extending from the lug portion 68 in oblique relation to the inner edge of tape 10. A pointed shoulder 72 extends from leg 70 and has a thickness less than the body. Similarly, stop member 66 has a body including a lug portion 74 extending substantially transverse to the inner edge of tape 12, a leg extending from the lug portion 74 obliquely with respect to the inner edge of tape 12, and a pointed shoulder 78 extending from the leg 70 and having a thickness less than the body.

Figure 4:
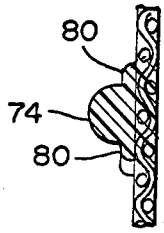
FIG. 4 is a section taken along line 4—4 of FIG. 3.

As best illustrated in FIG. 4, the leg and lug portions of the stop members 64 and 66 are each of arcuate or semi-circular shape in cross-section with smooth external surfaces, and the stop members are formed of masses of fusible plastic material molded onto the tapes and heated to fuse the material with the tape thereby causing a margin 80 to be produced around the leg and lug portions having a thickness less than the thickness of shoulders 72 and 78.

Top stop members 64 and 66 are secured to tapes 10 and 12, respectively, on the side of the tapes opposite the side from which the pull 54 of the slider extends; and, similarly, a bottom stop 82 made of a mass of fusible material is fused to the same side of the tapes as stop members 64 and 66 to limit opening or separating movement of the slider 22 at a non-separating end of the slide fastener.

Figure 7:
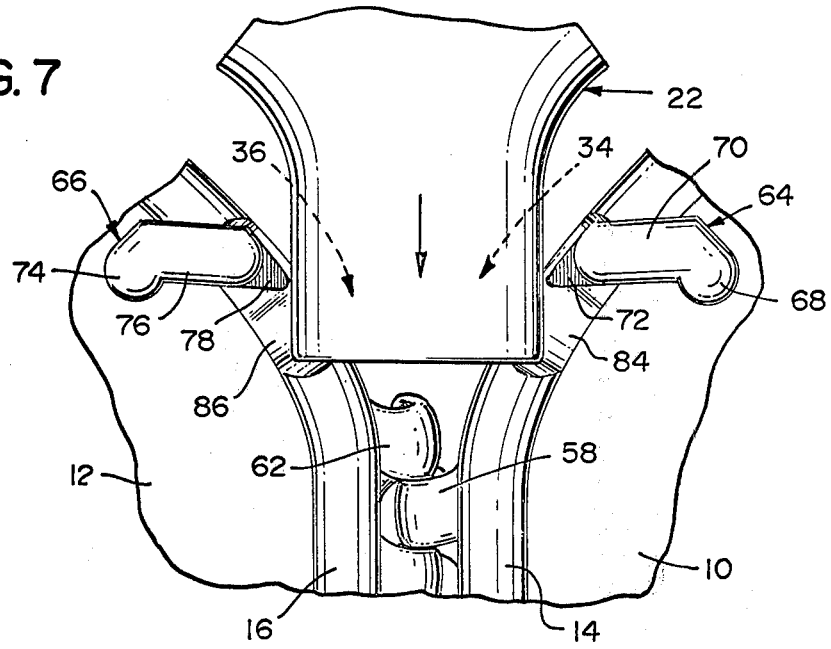
FIG. 7 is an enlarged broken rear elevation of the slide fastener of FIG. 1 during the installation of a slider.

In order to assemble a slide fastener in accordance with the present invention, continuous tapes and fastener elements, referred to as a stringer, are produced. The stringer is then gapped to remove fastener elements from portions of the stringer to form gapped areas along each cord. The cords 14 and 16 of the tapes now have portions 84 and 86, respectively reduced in cross section in any suitable manner such as by welding with ultrasonic vibrations supplied to a die to flatten the portions 84 and 86. Top stop members 64 and 66 are now formed on the tapes at the edges of portions 84 and 86, as shown in FIGS. 3 and 7, with cord portions 84 and 86 disposed between the terminal fastener elements, the inner most edges of the legs 70 and 76 and the shoulders 72 and 78 being spaced a small distance from the inner edges of the cords. Preferably, bottom stop 82 is secured to the tapes simultaneously with top stop members 64 and 66 with both the top and bottom stops formed of masses of plastic material fused to the same side of the tapes.

The slider 22 is installed by disposing the tail 28 of the slider to receive the cord portions 84 and 86 of reduced cross section at channels 34 and 36, the tapes 10 and 12 being splayed to expose flattened cord portions 84 and 86. The slider 22 is now moved along cords 14 and 16 in the direction of the arrow away from stop members 64 and 66 to position the fastener elements and the cords in channels 34 and 36 of the slider.

Once the slider is installed, the slide fastener is applied to a garment or other object, and, in operation, when the slider is moved to close the slide fastener, the slider will travel along the inner edges of tapes 10 and 12 with the cords 14 and 16 and the fastener elements 18 and 20 carried thereby received in the longitudinal channels 34 and 36 in the slider, respectively, to interengage the fastener elements as they converge. When the slider reaches the terminal portions of the fastener elements 18 and 20, it moves past the end elements 58 and 62 and along the gaps L1 and L2 of the bare portions of the cords 14 and 16 until end abutments 46 and 48 of the slider engage the stop members 64 and 66. The orientation of the legs and shoulders of the top stop members guides the slider into abutment with the bodies of the stop members and prevents disassembly of the slider. The oblique orientation of the legs 70 and 76 corresponds to the configuration of the diverging throats 42 and 44 of the slider such that the legs are received within the throats while the engagement of the top stops with the end abutments 46 and 48 limits further movement of the slider. As shown in FIG. 2A, the mating configuration of the stop members 64 and 66 with the throats 42 and 44 of the slider permits the slide fastener to be completely closed while preventing splay of the extensions of tapes 10 and 12.

Figure 8:
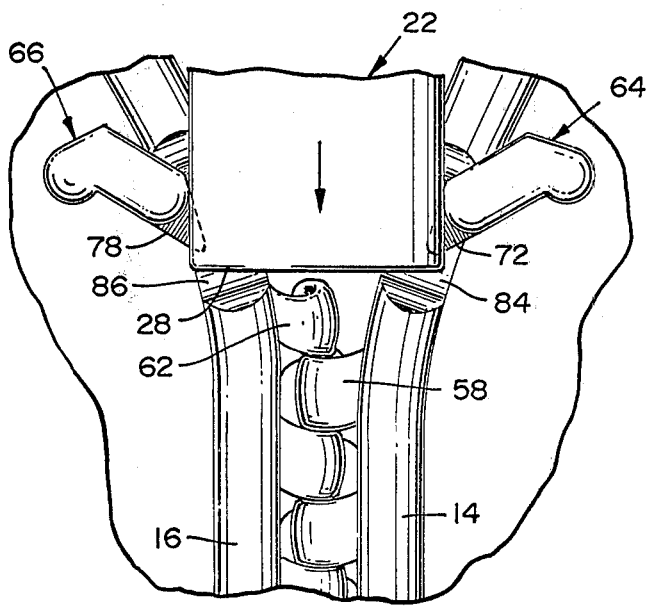
FIG. 8 is an enlarged broken rear elevation of a modification of the slide fastener of FIG. 1 during the installation of a slider.

A modification of the slide fastener and assembling method of the present invention is illustrated in FIG. 8 with elements of FIG. 8 identical to elements of the slide fastener of FIGS. 1–7 given identical reference numbers. The primary difference in the modification of FIG. 8 is that there are no gapped areas of the cords between the terminal fastener elements and the top stop members. Accordingly, the innermost edges of shoulders 72 and 78 and legs 70 and 76 are spaced further from the inner edges of the tapes such that the tail 28 of the slider can receive the cord portions 84 and 86 of reduced cross section adjacent the top stop members.

Installation of the slider with the slide fastener of FIG. 8 is substantially the same as that described above except that the tail 28 of the slider is introduced at the top stops with the tapes splayed such that cord portions 84 and 86 and shoulders 72 and 78 are received in the channels 34 and 36. The slider is then moved in the direction of the arrow away from the top stop members to position the fastener elements and the cords in the channels in the slider.

While the slide fastener and method of the present invention are most advantageous with the use of the reduced cross section cord portions, the gapped areas between the cord portions and the stop members, and the pointed shoulders of reduced thickness of the stop members in combination, the present invention can be practiced, for instance, with gapped areas but without reduced cross section cord portions or with the reduced cross section cord portions but without the gapped areas or without the pointed shoulders. It is important primarily that the slider receive the cords without interference by the fastener elements, such as by using the gapped areas or spacing the stop members from the inner edges of the tapes to permit introduction of the slider adjacent the stop members. The pointed shoulders serve as guides during installation of the slider and need not be received in the channels of the slider, and the combination of the oblique legs and the pointed shoulders serve to center the tail of the slider during installation of the slider.

The steps of the method of the present invention may be performed in any order desired; however, the method described above is extremely advantageous in optimizing slide fastener manufacture. Similarly, the steps may be implemented in any suitable manner. For instance, only relative motion between the slider and stringer is required for installation of the slider; and, thus, the slider can be held stationary while the stringer is moved toward the tail of the slider.

As well as facilitating installation of the slider, the pointed shoulders 72 and 78 of the stop members 64 and 66 facilitate entrance of the legs of the stop members in the throats 42 and 44, and the sliding movement of the slider 22 along the cords 14 and 16 in the gaps L1 and L2 provides a smooth, silent closure and facilitates opening without jamming of the slider. By securing the top stop members 64 and 66 and the bottom stop 82 on the back side of tapes 10 and 12 opposite the side of the tapes 10 and 12 from which the pull 54 of the slider extends aesthetic qualities of the slide fastener are improved since the top and bottom stops are hidden from view, and the smooth, rounded external configuration of the stop members prevents irritation.

Inasmuch as the present invention is subject to variations, modifications and changes in detail, it is intended that all matter described above or shown in the accompanying drawings be interpreted as illustrative and not in a limiting sense.

What is claimed is:

1. A method of assembling slide fasteners from a pair of tapes each having a cord along the inner edge thereof carrying interengageable fastener elements, the method comprising the steps of forming a stop member on each of the tapes;

reducing the cross section of areas of the cords adjacent the stop members;

disposing a slider to receive in channels there through the reduced cross section areas of the cords; and moving the slider along the cords away from the stop members to position the fastener elements in the channels through the slider.

2. The method as recited in claim 1 wherein terminal elements of the fastener elements are spaced from the stop members and the reduced cross section areas of the cords are disposed between the terminal fastener elements and the stop members.

3. The method as recited in claim 1 and further comprising splaying the tapes such that the cords are bent adajcent the reduced cross section areas prior to said slider disposing step.

4. The method as recited in claim 3 wherein the stop members have legs obliquely oriented with respect to the inner edges of the tapes.

5. The method as recited in claim 4 wherein the legs of the stop members terminate at positions spaced from the inner edges of the tapes.

6. The method as recited in claim 5 wherein each of the members has a pointed shoulder extending from the leg, the pointed shoulder having a thickness less than the thickness of the legs.

7. A method of assembling slide fasteners from a pair of tapes each having a cord along the inner edge thereof carrying interengageably fastener elements, the method comprising the steps of forming a stop member on each of the tapes at positions spaced from terminal elements of the fastener elements to define gapped areas along the cords between the stop members and the terminal fastener elements;

disposing a slider to receive in channels therethrough the gapped areas along the cords; and moving the slider along the cords away from the stop members to position the fastener elements in the channels through the slider.

8. The method as recited in claim 7 and further comprising the step of splaying the tapes such that the cords are bent adjacent the gapped areas prior to said slider disposing step.

9. A method of manufacturing slide fasteners comprising the steps of producing a stringer including a pair of continuous tapes having cords along the inner edges thereof, each of the cords carrying fastener elements formed of a continuous filament of plastic material;

moving the fastener elements from portions of the stringer to form gapped areas along each cord;

reducing the cross section of the cords along portion of the gapped areas adjacent terminal elements of the fastener elements;

forming a stop member on each of the tapes spaced from the terminal fastener elements such that the cord portions of reduced cross section are disposed between the stop members and the terminal fastener elements;

disposing a slider to receive the cord portions of reduced cross section at channels through the slider; and moving the slider along the cords away from the stop members to position the cords and fastener elements in the slider channels.

10. The method as recited in claim 9 wherein said cord portion cross section reducing step includes flattening the cords utilizing ultrasonic vibrations.

11. The method as recited in claim 10 wherein said stop member forming step includes fusing masses of plastic material to said tapes.

12. The method as recited in claim 9 and further comprising the step of securing a bottom stop member to both of the tapes to define a non-separating end for the slide fasteners spaced from the stop members, said bottom stop securing step being performed simultaneously with the stop member forming step and including fusing a mass of plastic material to both of the tapes.

13. The method as recited in claim 9 wherein said stop member forming step includes forming the stop members with legs extending obliquely to the inner edges of the tapes and pointed shoulders of reduced thickness relative to the legs extending from the legs, and said slider disposing step includes receiving the pointed shoulders of the stop members in the channels of the slider.

* * * * *